US010384894B2

(12) United States Patent
Narikiyo et al.

(10) Patent No.: US 10,384,894 B2
(45) Date of Patent: Aug. 20, 2019

(54) SHEET FEEDING DEVICE AND IMAGE FORMING APPARATUS

(71) Applicant: SHARP KABUSHIKI KAISHA, Sakai, Osaka (JP)

(72) Inventors: Takahisa Narikiyo, Sakai (JP); Toshihiko Seike, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/865,787

(22) Filed: Jan. 9, 2018

(65) Prior Publication Data

US 2018/0201458 A1 Jul. 19, 2018

(30) Foreign Application Priority Data

Jan. 17, 2017 (JP) ..... 2017-005501

(51) Int. Cl.

*B65H 1/12* (2006.01)
*B65H 5/06* (2006.01)
*B65H 1/14* (2006.01)

(52) U.S. Cl.

CPC ..... *B65H 5/068* (2013.01); *B65H 1/12* (2013.01); *B65H 1/14* (2013.01); *B65H 2402/64* (2013.01); *B65H 2403/72* (2013.01); *B65H 2405/324* (2013.01); *B65H 2407/21* (2013.01); *B65H 2701/1826* (2013.01); *B65H 2801/03* (2013.01); *B65H 2801/06* (2013.01)

(58) Field of Classification Search

CPC ..... B65H 1/12; B65H 1/14; B65H 2403/72; B65H 2403/733; B65H 2405/324

See application file for complete search history.

(56) References Cited

U.S. PATENT DOCUMENTS

| | | | | |
|---|---|---|---|---|
| 7,270,323 | B2 * | 9/2007 | Somemiya | B65H 3/0669 271/114 |
| 9,126,784 | B2 * | 9/2015 | Aoki | B65H 1/12 |
| 2005/0140081 | A1 * | 6/2005 | Sugimura | B65H 1/04 271/118 |
| 2015/0001788 | A1 | 1/2015 | Aoki et al. | |

FOREIGN PATENT DOCUMENTS

| | | |
|---|---|---|
| JP | 2015-009933 A | 1/2015 |

* cited by examiner

*Primary Examiner* — Howard J Sanders
(74) *Attorney, Agent, or Firm* — ScienBiziP, P.C.

(57) ABSTRACT

A sheet feeding device includes a rotation shaft that rotates in synchronism with rotation of the feed member, a spring clutch that is deformable to be in a tightened state and to be in a loosened state, and a pressure-receiving member that becomes displaced from a first position to a second position by receiving a pressing force that is generated as the spring clutch swings. The spring clutch starts to be loosened from the tightened state as a first end portion of the spring clutch becomes engaged with an engagement portion when the pressure-receiving member is displaced to the second position.

16 Claims, 14 Drawing Sheets

SHEET FEEDING DEVICE AND IMAGE FORMING APPARATUS

BACKGROUND

1. Field

The present disclosure relates to a sheet feeding device and an image forming apparatus. In particular, the present disclosure relates to, for example, a sheet feeding device and an image forming apparatus that feed a sheet on a tray to a destination by using a feed roller.

2. Description of the Related Art

An example of existing sheet feeding devices is disclosed, for example, in Japanese Unexamined Patent Application Publication No. 2015-9933. The sheet feeding device described in Japanese Unexamined Patent Application Publication No. 2015-9933 is a sheet feeding device that feeds a sheet placed on a tray to a destination by rotating a feed roller. The sheet feeding device includes a pressing member (rotary plate) that can move up and down between a pressing position where the pressing member presses a sheet against the feed roller and a release position where the pressing member does not press a sheet against the feed roller. The sheet feeding device further includes a restraining mechanism and a synchronous mechanism. The restraining mechanism is movable between a restraining position where the restraining mechanism restrains an upward movement of the pressing member to the pressing position and a non-restraining position where the restraining mechanism does not restrain the upward movement. The synchronous mechanism moves the restraining mechanism to the non-restraining position in synchronism with rotation of the feed roller. The synchronous mechanism includes a synchronous rotation member (spur gear) that rotates in synchronism with rotation of the feed roller, a contact member (swing arm) that contacts a swing member (rotation lever) of the restraining mechanism and displaces the swing member, and a compression spring (spring clutch) that presses the synchronous rotation member against the contact member.

With the technology described in Japanese Unexamined Patent Application Publication No. 2015-9933, the torque (braking force) of the compression spring starts to decrease from the time when the contact member contacts the swing member of the restraining mechanism (that is, the time when pressing starts). In order that the contact member can displace the swing member without fail, in consideration of variation of the load, it is necessary to keep the torque of the compression spring to be larger than a certain value. On the other hand, in order to smoothly rotate the feed roller without applying an excessive load to the synchronous rotation member and the like, it is preferable that the torque of the compression spring be small. Therefore, with the technology described in Japanese Unexamined Patent Application Publication No. 2015-9933, it is necessary to strictly control the torque of the compression spring.

SUMMARY

It is desirable to provide a sheet feeding device and an image forming apparatus that are novel.

It is also desirable to provide a sheet feeding device and an image forming apparatus that do not need torque management of a spring clutch.

According to an aspect of the disclosure, there is provided a sheet feeding device that feeds a sheet on a tray to a destination by using a feed member. The sheet feeding device includes a rotation shaft that rotates in synchronism with rotation of the feed member, a spring clutch that is deformable to be in a tightened state in which the spring clutch swings as the rotation shaft rotates and to be in a loosened state in which the spring clutch does not swing as the rotation shaft rotates, and a pressure-receiving member that becomes displaced from a first position to a second position by receiving a pressing force that is generated as the spring clutch swings. The spring clutch is in the tightened state when the spring clutch is in an initial position, and the spring clutch starts to be loosened from the tightened state as a first end portion of the spring clutch becomes engaged when the spring clutch swings to a predetermined swing position and the pressure-receiving member is displaced to the second position.

DESCRIPTION OF THE EMBODIMENTS

First Embodiment

Figure 1:
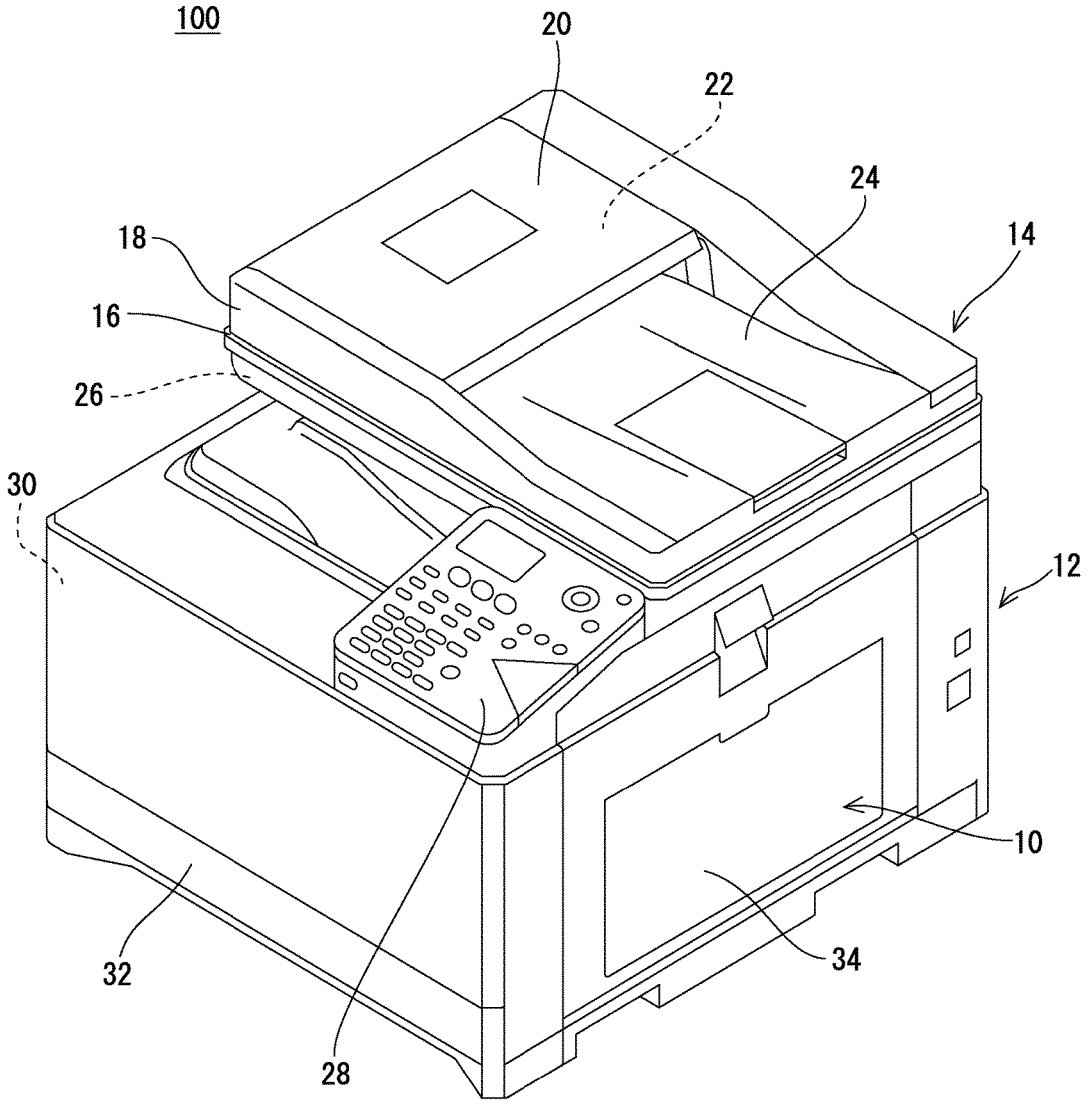
FIG. 1 illustrates an external view of an image forming apparatus including a sheet feeding device according to a first embodiment of the present disclosure.
Figure 2:
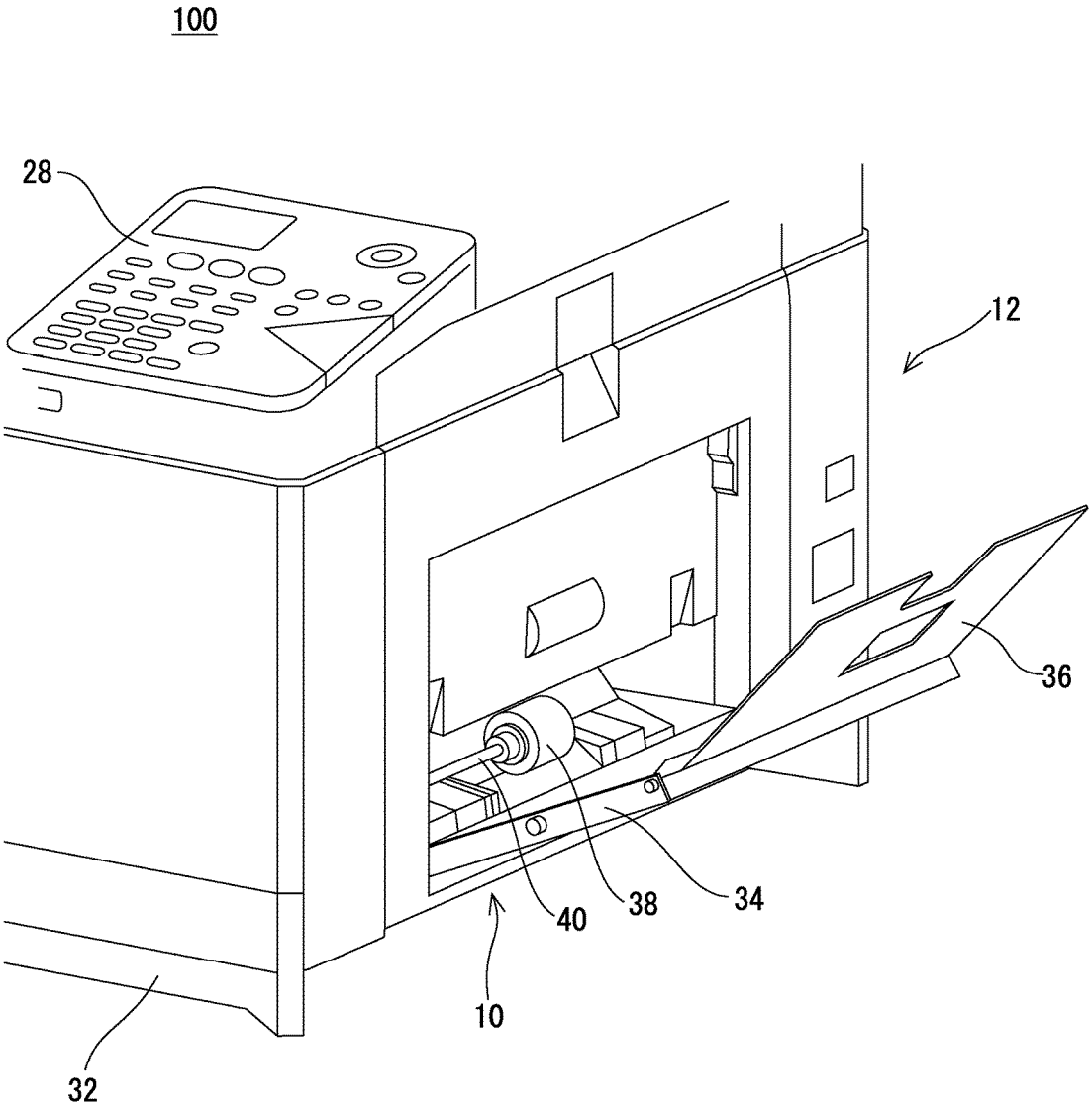
FIG. 2 illustrates a manual feed tray of the image forming apparatus in an open state.

Referring to FIGS. 1 and 2, a sheet feeding device 10 according to a first embodiment of the present disclosure is a device that feeds a sheet placed on a tray to a destination. The sheet feeding device 10 is used for an image forming apparatus, such as a copier, a facsimile, a printer, or a multifunctional machine that functions as these devices.

In the first embodiment, the sheet feeding device 10 is used, for example, as a manual sheet feeder of a multifunctional machine 100 that has a copier function, a printer function, a scanner function, a facsimile function, and the like. As described below in detail, the sheet feeding device 10 includes a feed roller 38 (feed member), a rotary plate 44, a restraining mechanism 60, a synchronous mechanism 70, and the like. The sheet feeding device 10 feeds a sheet placed on a manual feed tray 34 to an image forming unit 30 by using the feed roller 38.

First, the structure of the multifunctional machine 100 will be schematically described. As illustrated in FIGS. 1 and 2, the multifunctional machine 100 includes an apparatus body 12, which includes the sheet feeding device 10, and an image scanning device 14, which is disposed above the apparatus body 2.

The image scanning device 14 includes a document platen 16 made of a transparent material. A document pressing cover 18 is openably/closably attached above the document platen 16 via a hinge or the like. A document feed tray 20 is openably/closably disposed on an upper surface of the document pressing cover 18, and an automatic document feeder (ADF) is disposed in the document feed tray 20. The ADF automatically feeds documents, which are placed on the document feed tray 20, one by one to an image scanner 26 and outputs the documents to a document output tray 24.

The image scanner 26, which is disposed in the image scanning device 14, includes a light source, a plurality of mirrors, a focusing lens, a line sensor, and the like. The image scanner 26 exposes a document surface to light and guides reflected light reflected from the document surface to the focusing lens via the plurality of mirrors. Then, the focusing lens focuses the reflected light on a light receiving element of a line sensor. The line sensor detects the luminance and the chromaticity of reflected light focused on the light receiving element and generates image data based on an image of the document surface. A charge coupled device (CCD), a contact image sensor (CIS), or the like is used as the line sensor.

An operation panel 28, which accepts an input operation such as a print command by a user, is disposed in front of the image scanning device 14. The operation panel 28 has various keys and a display unit.

A controller (not shown), which includes a CPU, a memory, and the like; the image forming unit 30; and the sheet feeding device 10 are disposed in the apparatus body 12. The controller sends control signals to various sections of the multifunctional machine 100 in accordance with an input operation performed on the operation panel 28 and the like and causes the multifunctional machine 100 to perform various operations.

The image forming unit 30 includes a photoconductor drum, a charger, an exposure device, a developing device, a transfer device, a fixing device, and the like. The image forming unit 30 forms an image on a sheet (recording sheet), which is transported from a sheet cassette 32 or the manual feed tray 34, by using an electrophotographic method. Then, the image forming unit 30 outputs the sheet, on which the image has been formed, to an output tray. For example, image data captured by the image scanner 26 of the image scanning device 14, image data transmitted from an external computer, or the like is used as image data for forming an image on a sheet.

The sheet cassette 32 is disposed in a lower part of the apparatus body 12 and can be pulled out toward the front side of the apparatus. The manual feed tray 34 is openably/closably, disposed in a side surface of the apparatus body 12. An auxiliary tray 36 is swingably attached to an upper end portion of the manual feed tray 34. The feed roller 38, which feeds a sheet placed on the manual feed tray 34, is disposed above a lower end portion of the manual feed tray 34. The feed roller 38 is rotatably supported by a rotation shaft 40. A driving source (not shown) is coupled to one end portion (opposite to the feed roller 38) of the rotation shaft 40 via a coupling gear and the like. As described above, the sheet feeding device 10 is used as a manual sheet feeder including the manual feed tray 34, the feed roller 38, and the like.

Figure 3A:
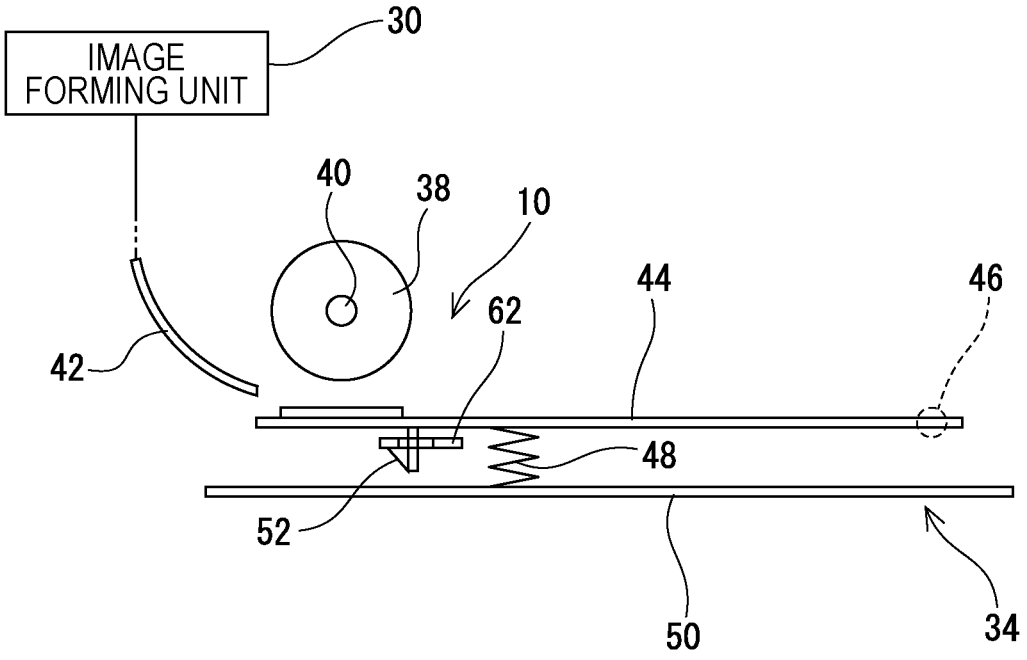
FIG. 3A schematically illustrates a state in which a rotary plate of the sheet feeding device is in a release position, and FIG. 3B schematically illustrates a state in which the rotary plate of the sheet feeding device is in a pressing position.
Figure 3B:
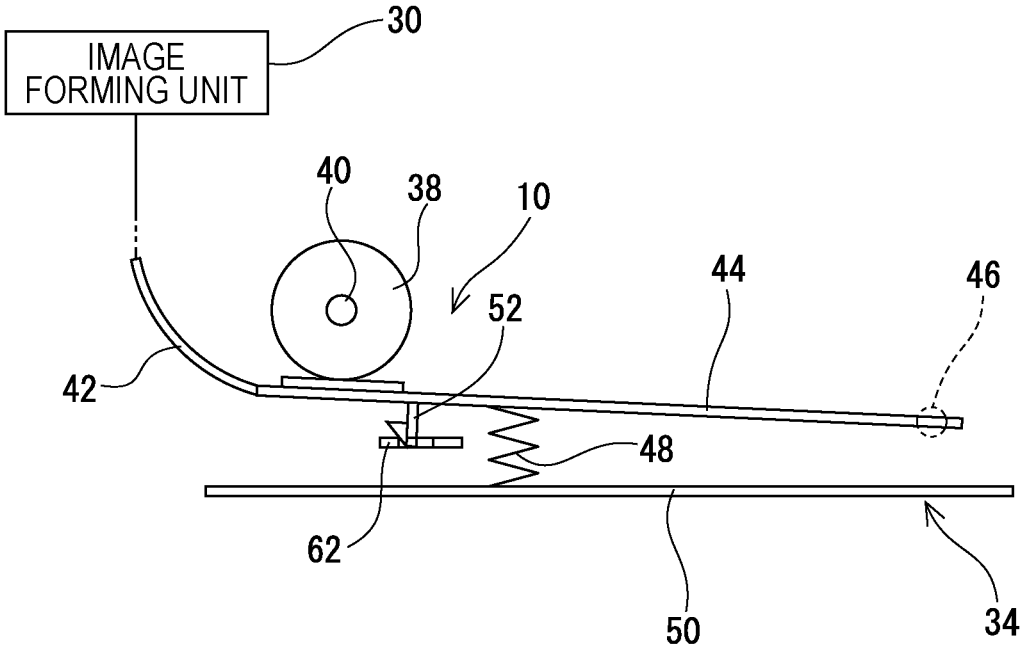
Figure 4:
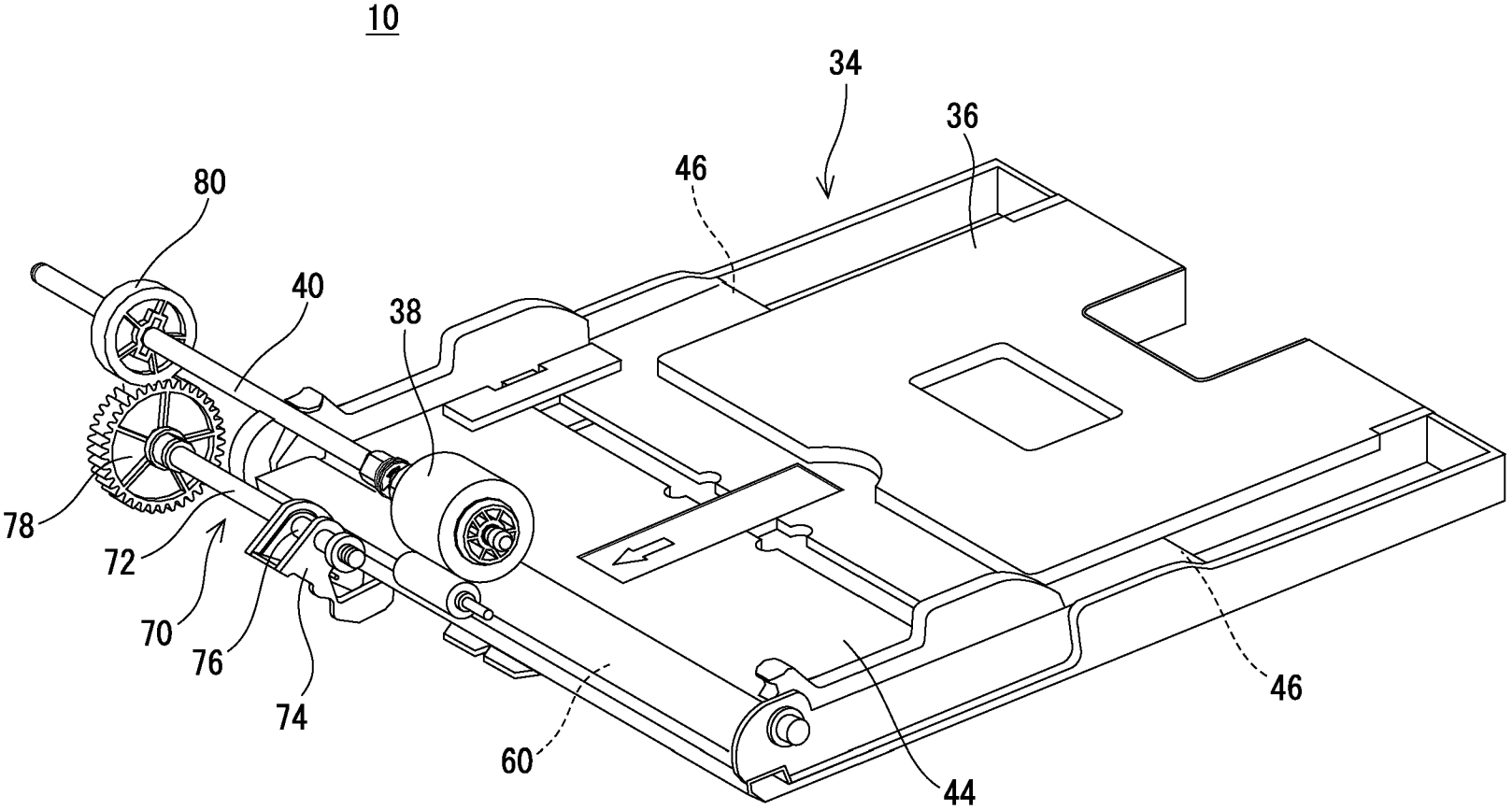
FIG. 4 schematically illustrates the overall structure of the sheet feeding device.

Next, the structure of the sheet feeding device 10 will be described. As illustrated in FIGS. 3 and 4, the sheet feeding device 10 includes the manual feed tray 34 and the feed roller 38. As the feed roller 38, which is rotatably supported by the rotation shaft 40, rotates, the sheet feeding device 10 feeds sheets, which are placed on the manual feed tray 34, one by one in order from an uppermost sheet to the image forming unit 30 along a transport guide 42.

The rotary plate 44 (up/down plate) is disposed on an upper surface portion of the manual feed tray 34. The rotary plate 44 can move up and down between a pressing position (see FIG. 3B), where the rotary plate 44 presses a sheet against toe feed roller 38, and a release position (see FIG. 3), where the rotary plate 44 does not press a sheet against the feed roller 38. When the rotary plate 44 is in the release position, a user can place a sheet on the manual feed tray 34. When the feed roller 38 starts rotating, the rotary plate 44 moves upward to the pressing position, and feeding of a sheet is started.

To be specific, the rotary plate 44 has a substantially rectangular shape and is swingable around a swing shaft 46 that is disposed parallel to the rotation shaft 40 of the feed roller 38. A compression spring 48 is disposed between the rotary plate 44 and a bottom wall 50 of the manual feed tray 34. The compression spring 48 urges the rotary plate 44 upward (toward the feed roller 38).

Engagement hooks 52, which engage with a lock plate 62 (described below) of the restraining mechanism 60, are disposed on a back surface of the rotary plate 44. When the engagement hooks 52 engage with the lock plate 62, the rotary plate 44 is held in the release position. When the engagement hooks 52 become disengaged from the lock late 62, the rotary plate 44 is pushed upward by the compression spring 48 to the pressing position.

Disengagement of the lock plate 62 of the restraining mechanism 60 from the engagement hooks 52 of the rotary plate 44 is performed in synchronism with rotation of the feed roller 38 by the synchronous mechanism 70 (described below). Hereinafter, the structures of the restraining mechanism 60 and the synchronous mechanism 70, which are included in the sheet feeding device 10, will be described.

Figure 5:
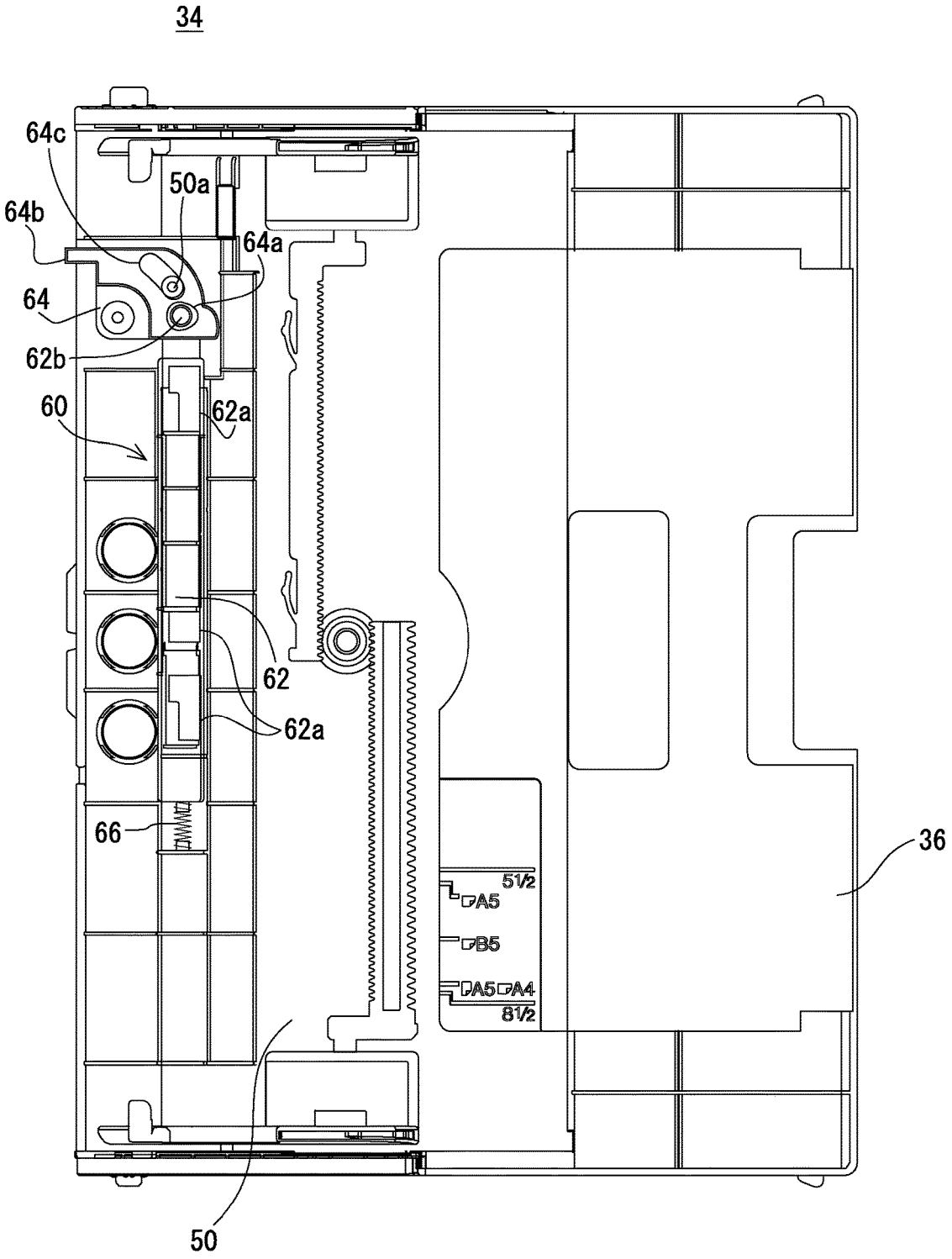
FIG. 5 illustrates the manual feed tray in a state in which the rotary plate is removed.
Figure 6:
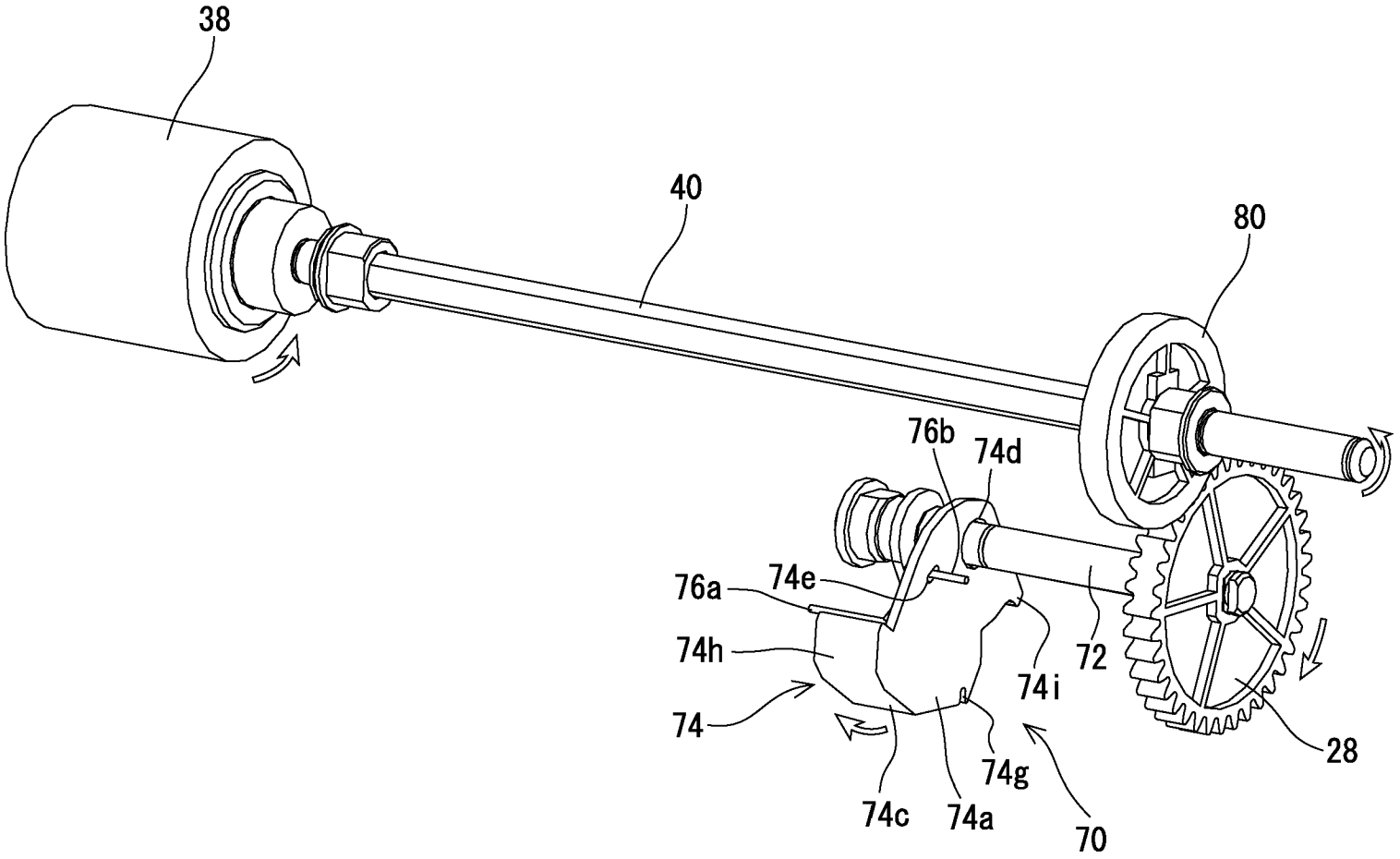
FIG. 6 illustrates a feed roller and a synchronous mechanism.
Figure 7:
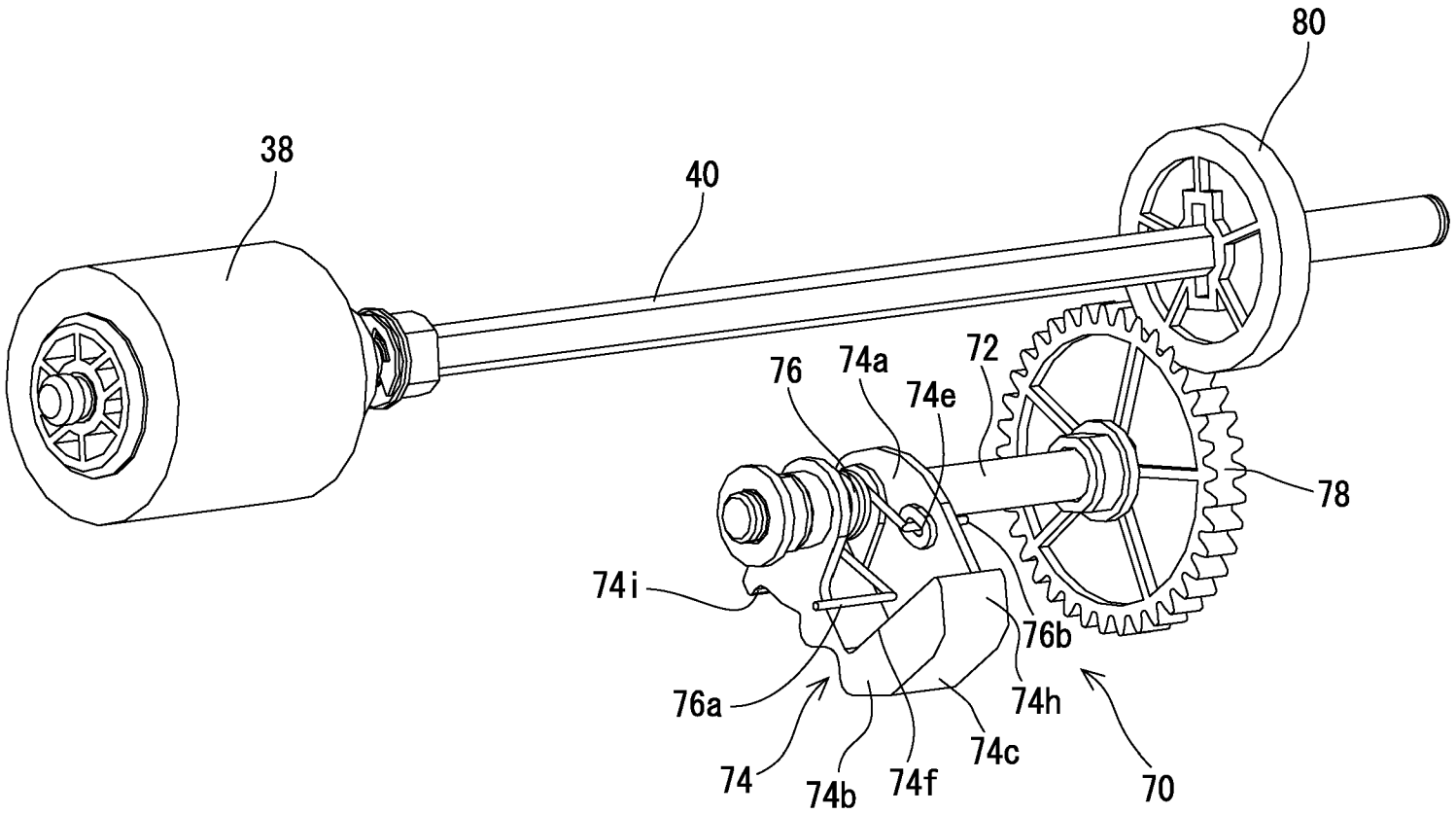
FIG. 7 illustrates the feed roller and the synchronous mechanism.
Figure 8:
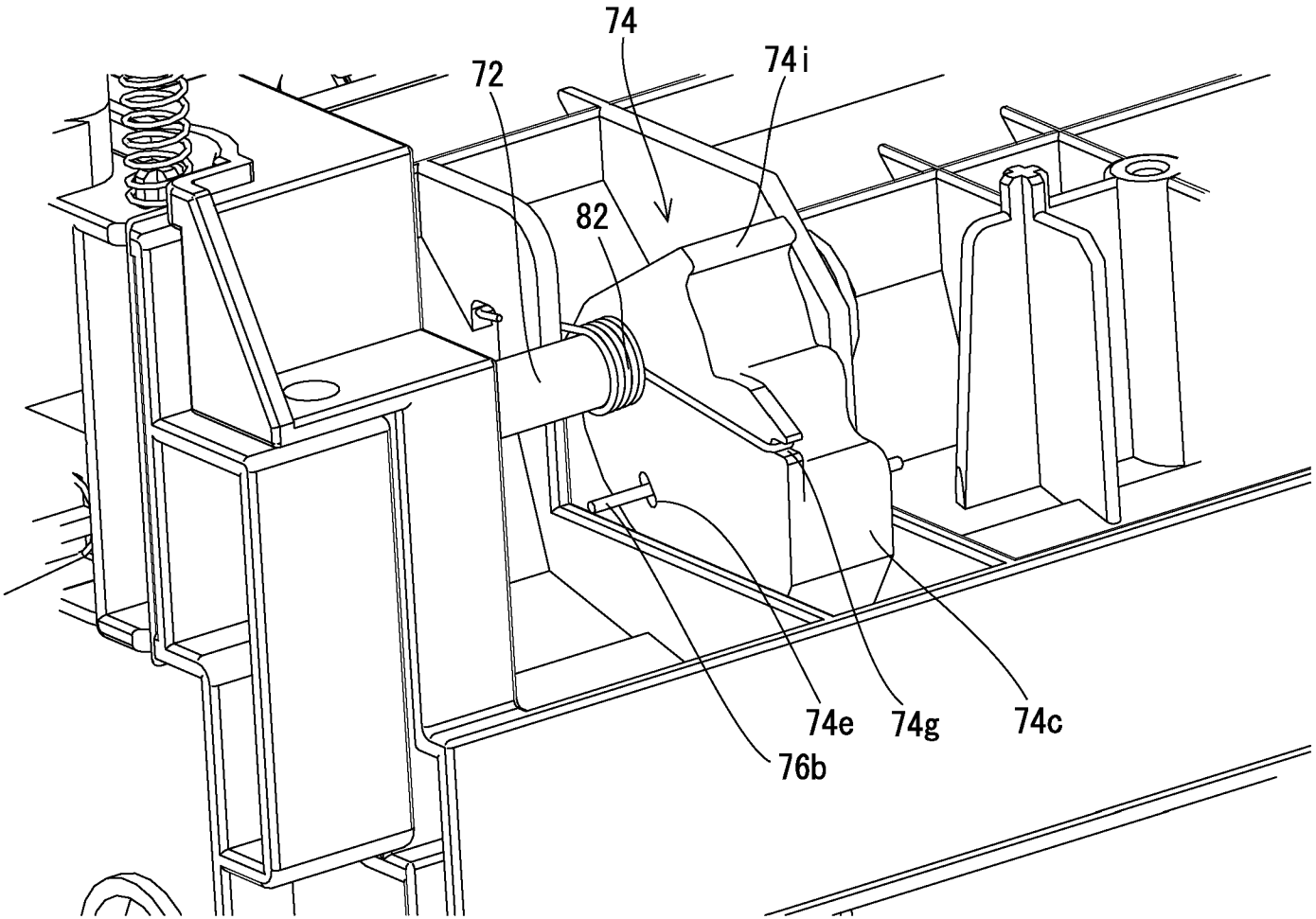
FIG. 8 illustrates a swing arm and a region surrounding the swing arm.
Figure 9:
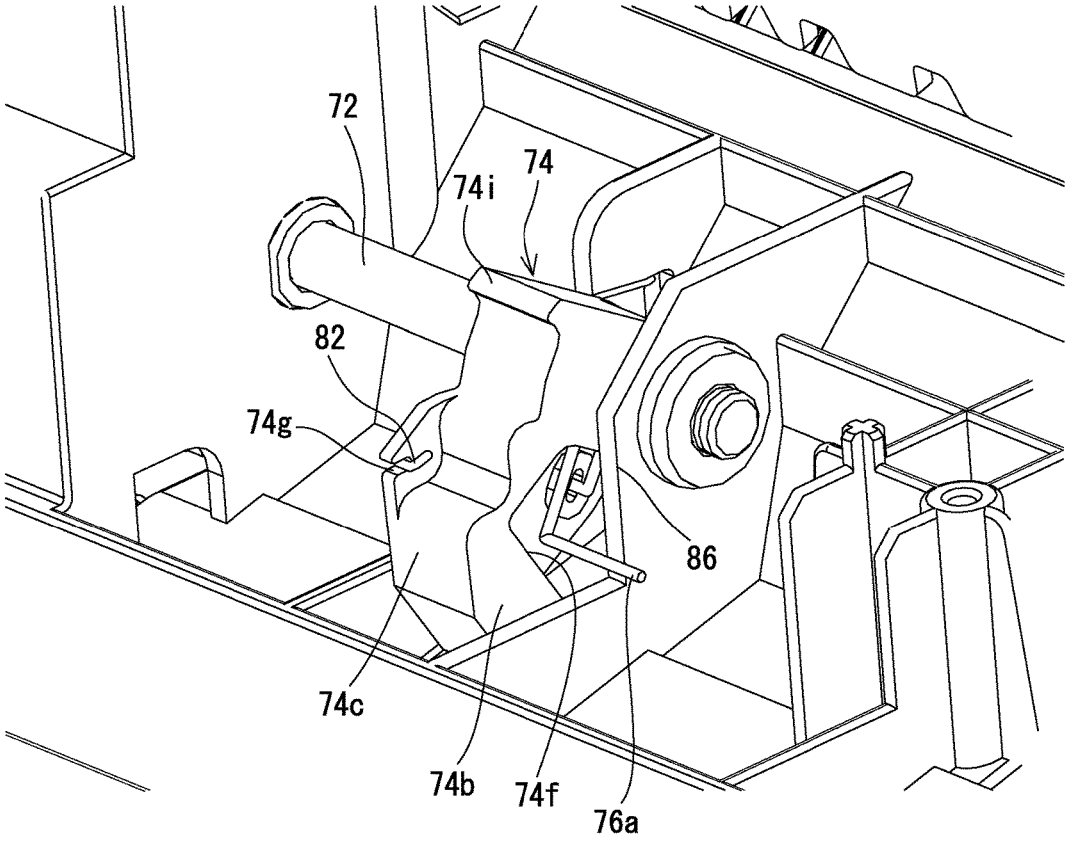
FIG. 9 illustrates the swing arm and a region surrounding the swing arm.

As illustrated in FIGS. 3 to 5, the restraining mechanism 60, which includes the lock plate 62 and a rotation lever 64, is disposed at an end portion of the manual feed tray 34 adjacent to the feed roller 38 and between the rotary plate 44 and the bottom wall 50.

The lock plate 62 is shaped like an elongated plate and disposed in such a way that the longitudinal direction thereof is parallel to the rotation shaft 40 of the feed roller 38. The lock plate 62 has engagement holes 62*a* at positions corresponding to the engagement hooks 52. The lock plate 62 is movable, in the longitudinal direction, between a restraining position, where the lock plate 62 restrains an upward movement of the rotary plate 44 from the release position to the pressing position, and a non-restraining position, where the lock plate 62 does not restrain the upward movement of the rotary plate 44. In the first embodiment, three engagement hooks 52 and three engagement notes 62*a* are arranged in the longitudinal direction of the lock plate 62. Although not illustrated in the figures, one of the three engagement hooks 52 in the middle has a hook portion protruding in the longitudinal direction of the lock plate 62, and two of the engagement hooks 52 near the ends have hook portions protruding in the width direction of the lock plate 62. The two engagement hooks 52 near the ends also function as guides for said movement of the lock plate 62.

A contact pin 62*b*, which is coupled to a coupling hole 64*a* of the rotation lever 64 (described below), protrudes upward from one end portion of the lock plate 62. Moreover, a compression spring 66 is disposed at the other end portion of the lock plate 62. The compression spring 66 urges the lock plate 62 in a direction from the other end portion toward the one end portion (toward the rotation lever 64).

The rotation lever 64 is a pressure-receiving member that is pressed by a swing arm 74 (described below) of the synchronous mechanism 70. The rotation lever 64 has a substantially sectoral plate-like shape whose central angle is substantially a right angle. The rotation lever 64 is swingable in the peripheral direction around the center of the sector. The rotation lever 64 is displaceable between a first position, which is the initial position, and a second position, where the rotation lever 64 moves the lock plate 62 to the non-restraining position.

The coupling hole 64*a*, into which the contact pin 62*b* is inserted, is formed at one end portion of the arc of the sectoral shape of the rotation lever 64. A protruding portion 64*b* (pressed portion), which contacts a pressing portion 74*h* of the swing arm 74 and receives a pressing force, protrudes from the other end portion of the arc of the sectoral shape of the rotation lever 64. Moreover, a guide hole 64*c*, which extends along the arc of the sectoral shape, is formed in a part of the rotation lever 64 between the coupling hole 64*a* and the protruding portion 64*b*. A guide protrusion 50*a*, which is formed on the bottom wall 50, is fitted into the guide hole 64*c*.

With the restraining mechanism 60, when the swing arm 74 applies a pressing force to the protruding portion 64*b* of the rotation lever 64, the rotation lever 64 converts the pressing force into a pressing force in a direction from one end portion toward the other end portion of the lock plate 62, and the pressing force is transmitted to the lock plate 62. Then, as the rotation lever 64 becomes displaced from the first position to the second position, the lock plate 62 moves from the restraining position to the non-restraining position, and the engagement holes 62*a* become disengaged from the engagement hooks 52 at the non-restraining position. Then, the rotary plate 44 moves upward from the release position to the pressing position due to the urging force from the compression spring 48. When the rotation of the feed roller 38 stops and the swing arm 74 stops applying the pressing force, the lock plate 62 moves from the non-restraining position to the restraining position due to an urging force from the compression spring 66 disposed at the other end portion of the lock plate 62. Accordingly, the rotation lever 64 returns from the second position to the first position. If a user depresses the rotary plate 44 when the lock plate 62 is in the restraining position, the engagement hooks 52 of the rotary plate 44 engage with the engagement holes 62*a* of the lock plate 62, and the rotary plate 44 is held in the release position.

Referring to FIG. 4 and FIGS. 6 to 9, the synchronous mechanism 70 is an unlocking mechanism for moving the lock plate 62 of the restraining mechanism 60 to the non-restraining position in synchronism with the rotation of the feed roller 38. The synchronous mechanism 70 includes a synchronous rotation shaft 72, the swing arm 74, and a spring clutch 76.

The synchronous rotation shaft 72 is disposed below the rotation shaft 40, which rotatably supports the feed roller 38, so as to be parallel to the rotation shaft 40. A first coupling gear 78 is disposed at one end portion of the synchronous rotation shaft 72. The first coupling gear 78 meshes with a second coupling gear 80, which is disposed at one end portion of the rotation shaft 40 (end portion to which a driving source (not shown) is coupled). Accordingly, the synchronous rotation shaft 72 rotates in synchronism with the rotation of the feed roller 38 by receiving a driving force from the driving source, which is the same as the driving source of the feed roller 38. The rotation shaft 40 and the synchronous rotation shaft 72 rotate in opposite directions.

The swing arm 74 is a pressing member that presses the rotation lever 64 of the restraining mechanism 60. The swing arm 74 is disposed at a position at the other end portion of the synchronous rotation shaft 72 corresponding to the position of the rotation lever 64. The swing arm 74 is loosely fitted onto the synchronous rotation shaft 72 and swingably attached to the synchronous rotation shaft 72.

To be specific, the swing arm 74 includes a first side wall 74*a*, a second side wall 74*b*, and a coupling wall 74*c*. The first side wall 74*a* and the second side wall 74*b* are plate-shaped and disposed parallel to a direction perpendicular to the synchronous rotation shaft 72. The coupling wall 74*c* couples the peripheral edges of the first side wall 74*a* and the second side wall 74*b* from upper portions, through back surface portions (opposite to the rotation lever 64), to front lower portions of the peripheral edges.

Retention holes 74*d*, into which the synchronous rotation shaft 72 is inserted, are formed in upper portions of the first side wall 74*a* and the second side wall 74*b*. The diameter of the retention holes 74*d* is greater than the diameter of the synchronous rotation shaft 72. A first engagement portion 74*e*, which is shaped like a hole, is formed in the first side wall 74*a*. A second end portion 76*b* of the spring clutch 76 (described below) engages with (is inserted into) the first engagement portion 74*e*. A cutout portion 74*f* is formed in the second side wall 74*b*. The cutout portion 74*f* allows displacement (opening motion) of a first end portion 76*a* of the spring clutch 76. Moreover, a protruding portion is formed on the hack surface portion of the first side wall 74*a*. A second engagement portion 74*g*, which engages with one end portion of an urging member 82 (described below, see FIG. 8), is formed in the protruding portion.

The pressing portion 74*h* is formed at a front lower part of the swing arm 74. The pressing portion 74*h* contacts the protruding portion 64*b* of the rotation lever 64 and applies a pressing force to the rotation lever 64. A restricting portion 74*i* is formed at a back upper part of the back surface of the swing arm 74. The restricting portion 74*i* restricts swinging of the swing arm 74. The restricting portion 74*i* restricts excessive swinging of the swing arm 74 after the swing arm 74 has reached a predetermined swing position by contacting a restricting bar 84 (see FIG. 13) disposed on the frame side.

The spring clutch 76 is attached to the synchronous rotation shaft 72 in a tightened state. In the tightened state, the spring clutch 76 rotates (swings) as the synchronous rotation shaft 72 rotates. When an end portion (arm portion)

of the spring clutch 76, which protrudes outward, is deformed in an opening direction, a coil portion of the spring clutch 76 is loosened, and the spring clutch enters a loosened state in which the synchronous rotation shaft 72 idles relative to the spring clutch 76. That is, the spring clutch 76 is deformable to be in a tightened state in which the spring clutch 76 swings as the synchronous rotation shaft 72 rotates and to be in a loosened state in which the spring clutch 76 does not swing as the synchronous rotation shaft 72 rotates.

In the first embodiment, the spring clutch 76 is used to transmit a rotational force of the synchronous rotation shaft 72 to the swing arm 74 and to stop transmitting the rotational force at a desired timing. To be specific, the spring clutch 76 is attached to the synchronous rotation shaft 72 at a position between the first side wall 74*a* and the second side wall 74*b* of the swing arm 74. The first end portion 76*a* of the spring clutch 76 is bent so as to extend parallel to the synchronous rotation shaft 72, extends through the cutout portion 74*f* of the second side wall 74*b*, and protrudes to the outside of the swing arm 74 in a free state. The second end portico 76*b* of the spring clutch 76 is bent so as to extend parallel to the synchronous rotation shaft 72 and is engaged with the first engagement portion 74*e* of the first side wall 74*a*.

An engagement portion 86 (see FIG. 9), which engages with the first end portion 76*a* of the spring clutch 76 when the spring clutch 76 moves to a predetermined swing position, is disposed on the frame side. That is, the engagement portion 86 contacts the first end portion 76*a* of the spring clutch 76 and restricts movement of the first end portion 76*a* at a timing at which the spring clutch 76 is to be loosened. In the first embodiment, an end surface of a vertical wall (rib) of the frame is used as the engagement portion 86.

The details of the operation of the synchronous mechanism 70 will be described below in detail. When the feed roller 38 rotates, the spring clutch 76 swings together with the synchronous rotation shaft 72, and the swing arm 74, which is coupled to the second end portion 76*b* of the spring clutch 76, also swings. When the spring clutch 76 reaches a predetermined swing position, the first end portion 76*a* of the spring clutch 76 engages with the engagement portion 86, and deformation of the spring clutch 76 to a loosened state (increase in the diameter of the coil portion) is started. When the spring clutch 76 enters the loosened state, the synchronous rotation shaft 72 idles relative to the spring clutch 76, and the spring clutch 76 and the swing arm 74 stop swinging.

The urging member 82, such as a return spring (kick spring), is attached to the swing arm 74. The urging member 82 is a member for appropriately returning the swing arm 74 and the spring clutch 76 to the initial position when the feed roller 38 stops. The urging member 82 urges the swing arm 74 in a direction opposite to the rotation direction of the synchronous rotation shaft 72. To be specific, a coil portion of the urging member 82 is loosely fitted onto the synchronous rotation shaft 72. One end portion of the urging member 82 is engage d with the second engagement portion 74*a* of the first side wall 74*a*, and the other end portion of the urging member 82 is engaged with an engagement portion on the frame side.

Figure 10:
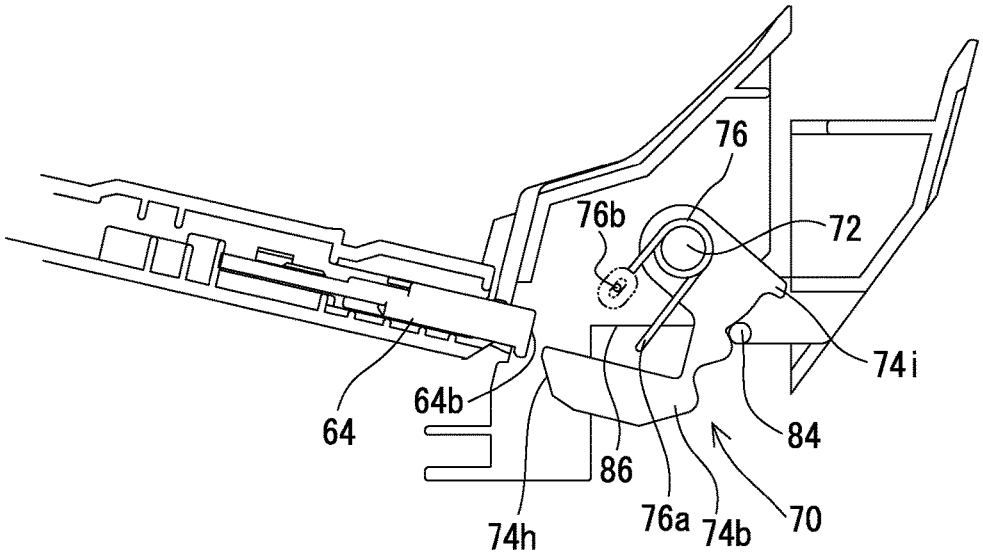
FIG. 10 illustrates an operation of the synchronous mechanism.
Figure 11:
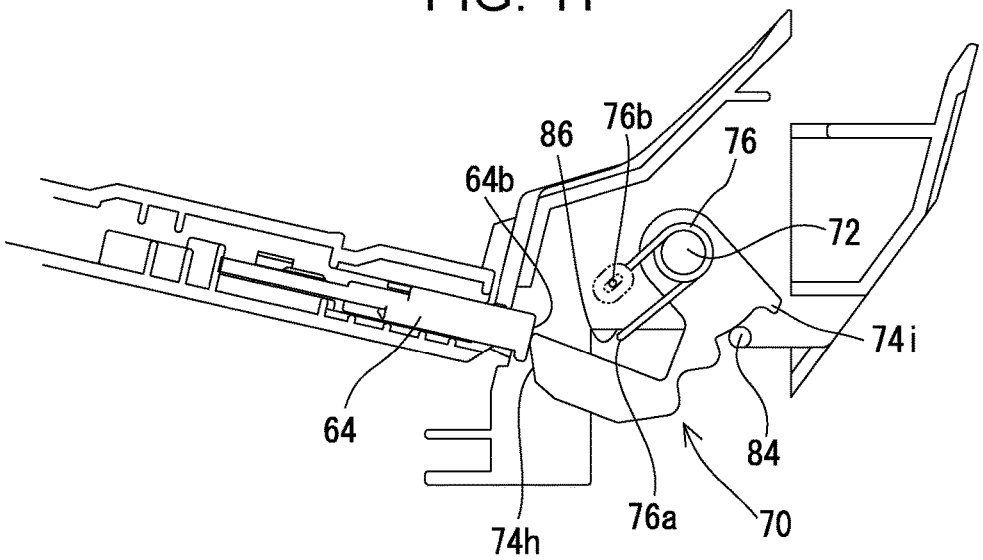
FIG. 11 illustrates the operation of the synchronous mechanism.
Figure 12:
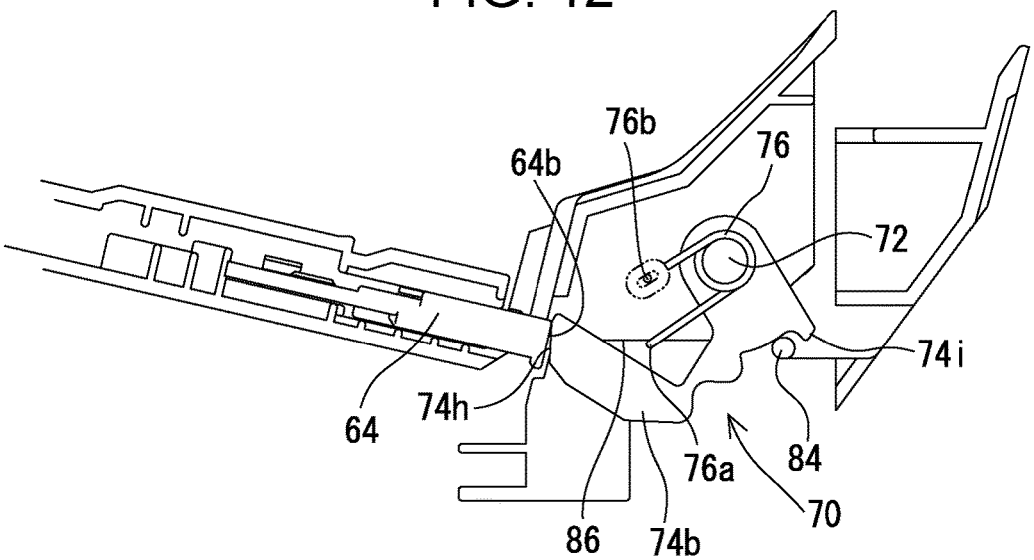
FIG. 12 illustrates the operation of the synchronous mechanism.
Figure 13:
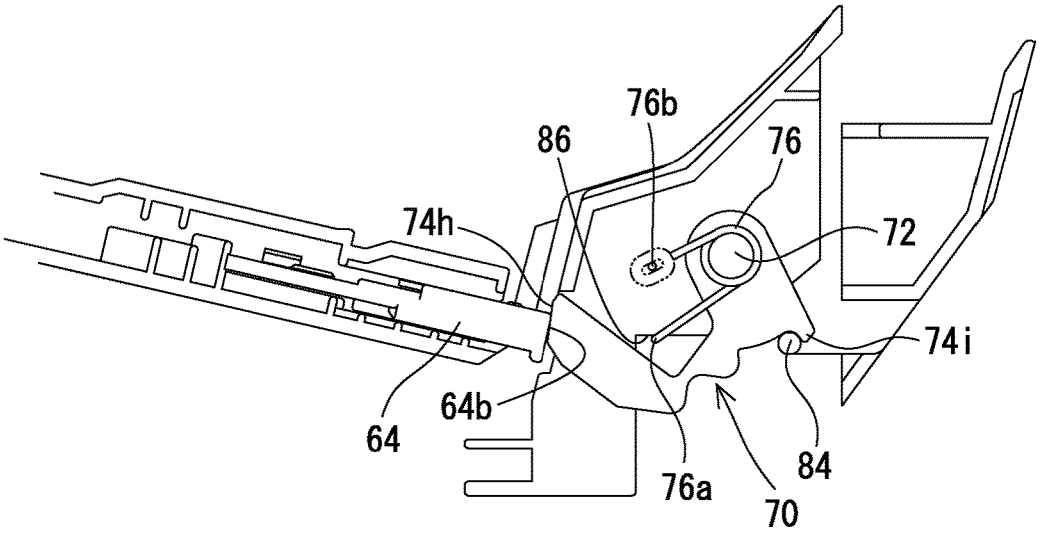
FIG. 13 illustrates the operation of the synchronous mechanism.

Next, referring to FIGS. 10 to 13, an operation of the synchronous mechanism 70 of the sheet feeding device 10 will be described. FIG. 10 illustrates a state in which the feed roller 38 is not rotating. FIG. 11 illustrates a state in which the rotation lever 64 has started displacement to the second position. FIG. 12 illustrates a state in which displacement of the rotation lever 64 to the second position has been finished. FIG. 13 illustrates a state in which the swing arm 74 has swung to a limit angle. Note that the first side wall 74*a* of the swing arm 74 is not illustrated in FIGS. 10 to 13.

As illustrated in FIG. 10, when the feed roller 38 is not rotating (that is, before the feed roller 38 starts rotating), the swing arm 74 and the spring clutch 76 are held in the initial position (initial angle) due to an urging force from the urging member 82. In the initial position, the spring clutch 76 is in a tightened state with respect to the synchronous rotation shaft 72. The rotation lever 64 is held in the first position.

As illustrated in FIG. 11, when the feed roller 38 starts rotating, the synchronous rotation shaft 72 also rotates in synchronism with the rotation of the feed roller 38. The spring clutch 76, which is in a tightened state with respect to the synchronous rotation shaft 72, swings; and the swing arm 74, which is coupled to the second end portion 76*b* of the spring clutch 76, also swings. Then, when the swing arm 74 swings to a certain angle, the pressing portion 74*h* of the swing arm 74 contacts the protruding portion 64*b* of the rotation lever 64, and the rotation lever 64 starts displacement to the second position by receiving a pressing force from the swing arm 74. At this time, the spring clutch 76 is still in the tightened state.

As illustrated in FIG. 12, when the swing angle of the swing arm 74 increases and displacement of the rotation lever 64 to the second position is finished, that is, when movement of the lock plate 62 from the restraining position to the non-restraining position is finished, the first end portion 76*a* of the spring clutch 76 becomes engaged with the engagement portion 86 at this timing. That is, the first end portion 76*a* of the spring clutch 76 becomes engaged when the spring clutch 76 swings to a predetermined swing position (specified angle) and the rotation lever 64 moves to the second position. Thus, the spring clutch 76 starts to be loosened. Then, when the spring clutch 76 swings a little further, the spring clutch 76 enters a loosened state (in which a braking force is not generated), the synchronous rotation shaft 72 idles relative to the spring clutch 76, and the spring clutch 76 and the swing arm 74 stop swinging. By loosening the spring clutch 76 after the rotation lever 64 has been displaced to the second position as described above, it is not necessary to perform torque control of the spring clutch 76 and load control of the rotation lever 64.

As illustrated in FIG. 13, swinging of the swing arm 74 beyond the limit angle is restricted, because the restricting portion 74*i* of the swing arm 74 contacts the restricting bar 84 when the swing arm 74 has swung to the limit angle. The restricting position is a position (angle) that has some margin so that the spring clutch 76 can deform to be in the loosened state without fail. Basically, the swing arm 74 stops swinging as the spring clutch 76 enters the loosened state before the swing arm 74 reaches the limit angle shown in FIG. 13. However, if the spring clutch 76 were loosened at an inaccurate timing, a component may become broken. Therefore, a relatively wide margin is set for the restricting position.

As described above, with the first embodiment, the spring clutch 76 continues to be in a tightened state until the rotation lever 64 (pressure-receiving member) becomes displaced to the second position, and the spring clutch 76 starts deformation to be in toe loosened state after the rotation lever 64 has reached the second position. Therefore, it is not necessary to perform torque control of the spring clutch 76. Moreover, it is not necessary to perform load control of the rotation lever 64.

Moreover, with the first embodiment, it is possible to reduce the number of gear components and to reduce the component cost, because the spring clutch 76 is directly attached to the synchronous rotation shaft 72.

Furthermore, with the first embodiment, it is possible to reduce the size of the apparatus and to simplify the control system, because a clutch operation is performed by using only a mechanical mechanism without using an electromagnetic clutch.

In the first embodiment, the second position of the rotation lever 64 is a position where the rotation lever 64 is located when the lock plate 62 moves to the non-restraining position. However, this is not a limitation. The second position of the rotation lever 64 may be set at a position that is slightly displaced from a position where the rotation lever 64 is located when the lock plate 62 moves to the non-restraining position.

Second Embodiment

Figure 14:
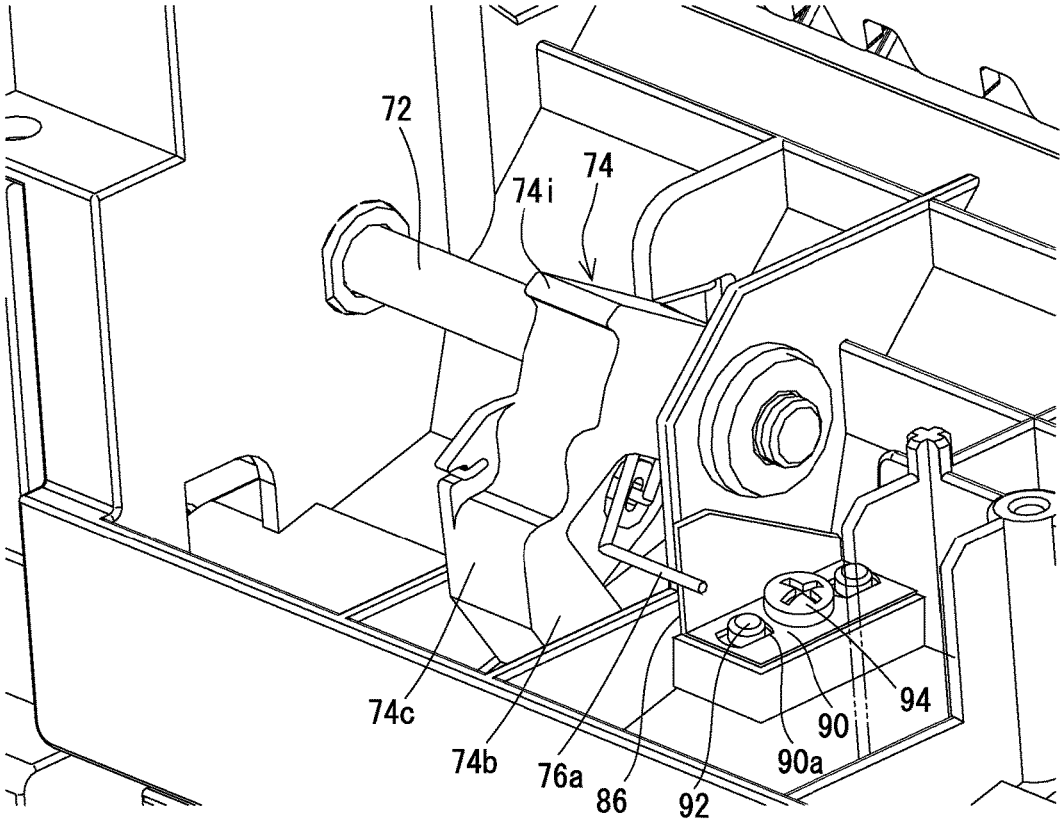
FIG. 14 illustrates a swing arm of a sheet feeding device according to a second embodiment of the present disclosure and a region surrounding the swing arm.

Next, referring to FIG. 14, a sheet feeding device 10 according to a second embodiment of the present disclosure will be described. The second embodiment differs from the first embodiment in the structure of the engagement portion 86. In other respects, the second embodiment is the same as the first embodiment. Therefore, portions of the second embodiment that are common to the first embodiment will be denoted by the same numerals and overlapping descriptions will be omitted or simplified.

In the second embodiment, the engagement portion 86 that engages with the first end portion 76*a* of the spring clutch 76 is disposed in such a way that the engagement position thereof is adjustable. That is, a predetermined swing position of the spring clutch 76 where deformation of the spring clutch 76 to a loosened state is started is adjustable. As illustrated in FIG. 14, in the second embodiment, an end surface of an L-shaped member 90, which is movably attached to the frame, is used as the engagement portion 86. The L-shaped member 90 includes a vertical piece, which extends along a vertical wall of the frame, and a horizontal piece, which extends perpendicular to the vertical piece. Guide holes 90*a* are formed in both end portions of the horizontal piece of the L-shaped member 90. The guide holes 90*a* are elongated holes extending along the vertical piece. Guide protrusions 92 of the frame are inserted into the guide holes 90*a*. Movement of the L-shaped member 90 in the longitudinal direction is guided by the guide holes 90*a* and the guide protrusions 92, and displacement of the position of the L-shaped member 90 is suppressed. An attachment hole (not shown), which has an elongated shape and into which a fixing member 94 such as a screw is inserted, is formed in a middle portion of the L-shaped member 90. The L-shaped member 90 is fixed by the fixing member 94 so that the engagement position thereof becomes a desired position.

The second embodiment has advantages the same as those of the first embodiment. That is, it is not necessary to perform torque control of the spring clutch 76 and to perform load control of the rotation lever 64.

Moreover, with the second embodiment, it is possible to adjust the engagement position where the spring clutch 76 engages with the engagement portion 86 in accordance with variation in the attachment angle of the spring clutch 76 and variation in the dimensions of components such as the swing arm 74.

Third Embodiment

Figure 15A:
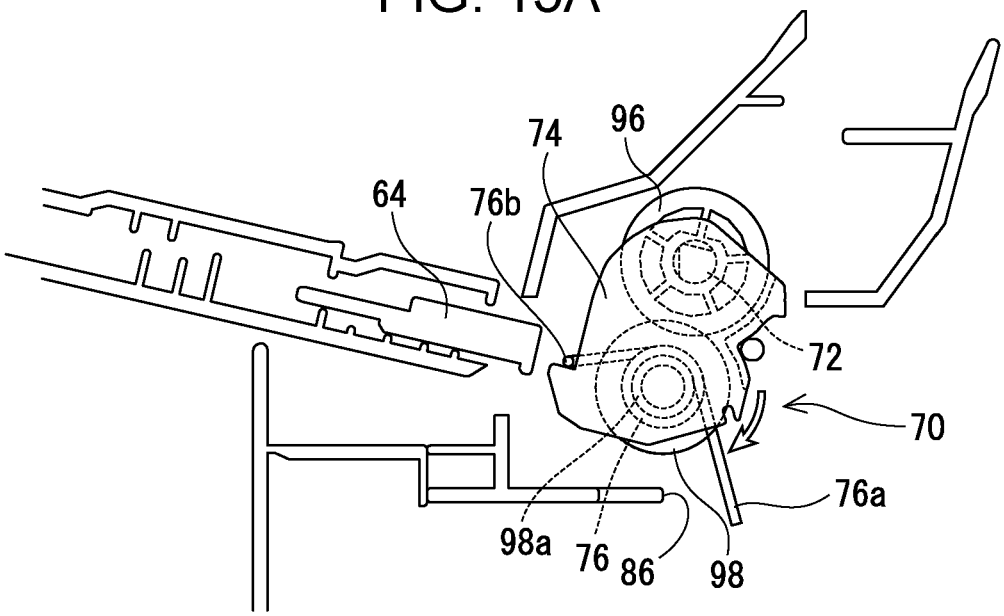
FIGS. 15A and 15B illustrate the structure and an operation of a synchronous mechanism of a sheet feeding device according to a third embodiment of the present disclosure.
Figure 15B:
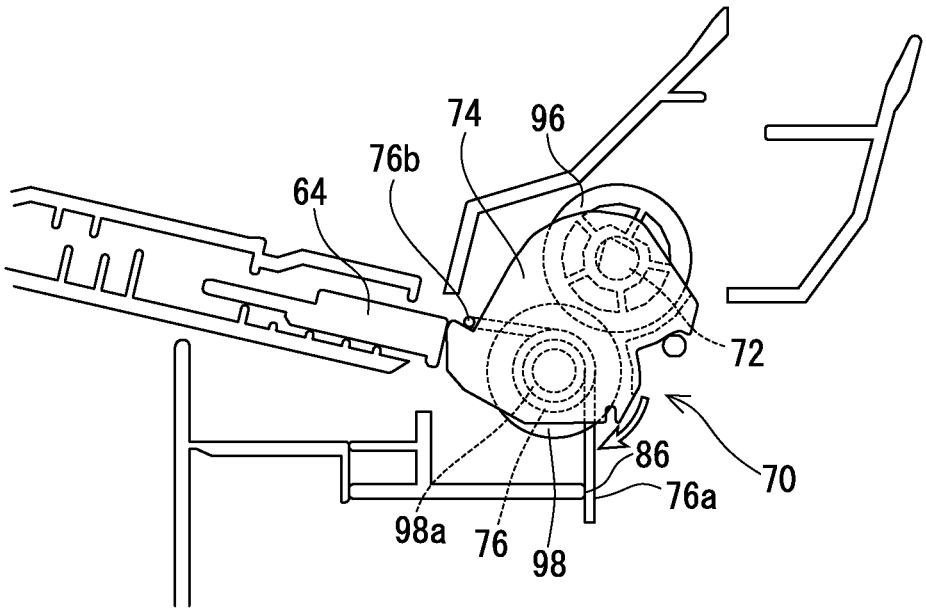

Next, referring to FIGS. 15A and 15B, a sheet feeding device 10 according to a third embodiment of the present disclosure will be described. The third embodiment differs from the first embodiment in the attachment position of the spring clutch 76. In other respects, the third embodiment is the same as the first embodiment. Therefore, portions of the third embodiment that are common to the first embodiment will be denoted by the same numerals and overlapping descriptions will be omitted or simplified.

In the third embodiment, the spring clutch 76 is attached to a rotation member 98 (gear) that rotates in synchronism with the rotation of the synchronous rotation shaft 72. To be specific, as illustrated in FIG. 15A, a coupling gear 96 is disposed on the synchronous rotation shaft 72, and the rotation member 98 is disposed so as to mesh with the coupling gear 96. The rotation shaft of the rotation member 98 is held by the swing arm 74. The spring clutch 76 is fixed to a boss 98*a* of the rotation member 98 in a tightened state. The second end portion 76*b* of the spring clutch 76 becomes engaged with the swing arm 74.

With the sheet feeding device 10, the rotation member 98 rotates in synchronism with rotation of the synchronous rotation shaft 72, and, accordingly, the spring clutch 76 and the swing arm 74 swing. When the spring clutch 76 reaches a predetermined swing position, as illustrated in FIG. 15B, the first end portion 76*a* of the spring clutch 76 engages with the engagement portion 86, and deformation of the spring clutch 76 to the loosened state is started. Then, when the spring clutch 76 enters the loosened state, the rotation member 98 idles relative to the spring clutch 76, and the spring clutch 76 and the swing arm 74 stop swinging.

The third embodiment has advantages the same as those of the first embodiment. That is, it is not necessary to perform torque control of the spring clutch 76 and to perform load control of the rotation lever 64.

However, the component cost of the third embodiment is higher than that of the first embodiment, because the rotation member 98 is used to transmit the rotation of the synchronous rotation shaft 72 to the spring clutch 76.

Fourth Embodiment

Figure 16A:
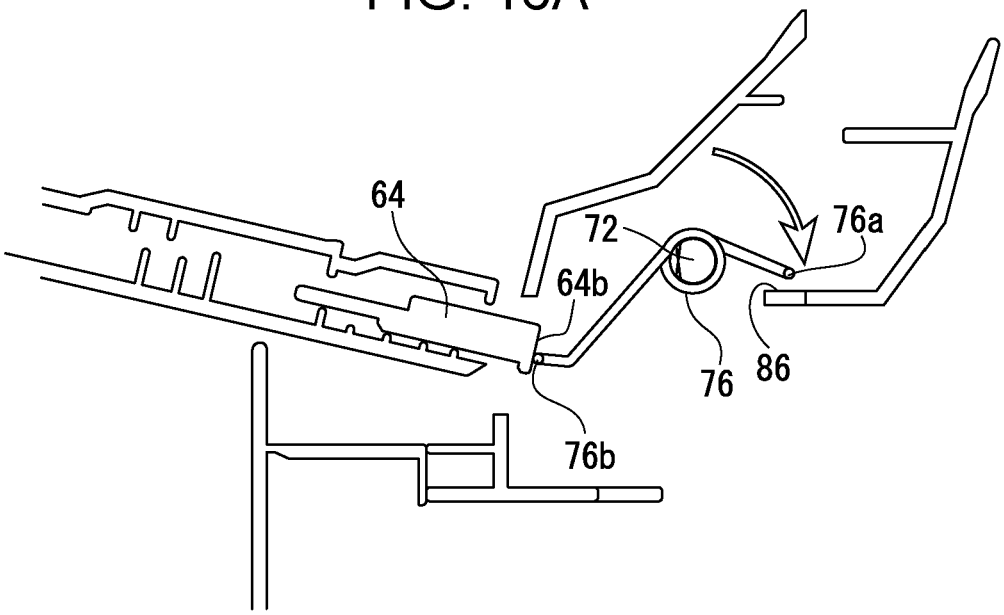
FIGS. 16A and 16B illustrate the structure and an operation of a synchronous mechanism of a sheet feeding device according to a fourth embodiment of the present disclosure.
Figure 16B:
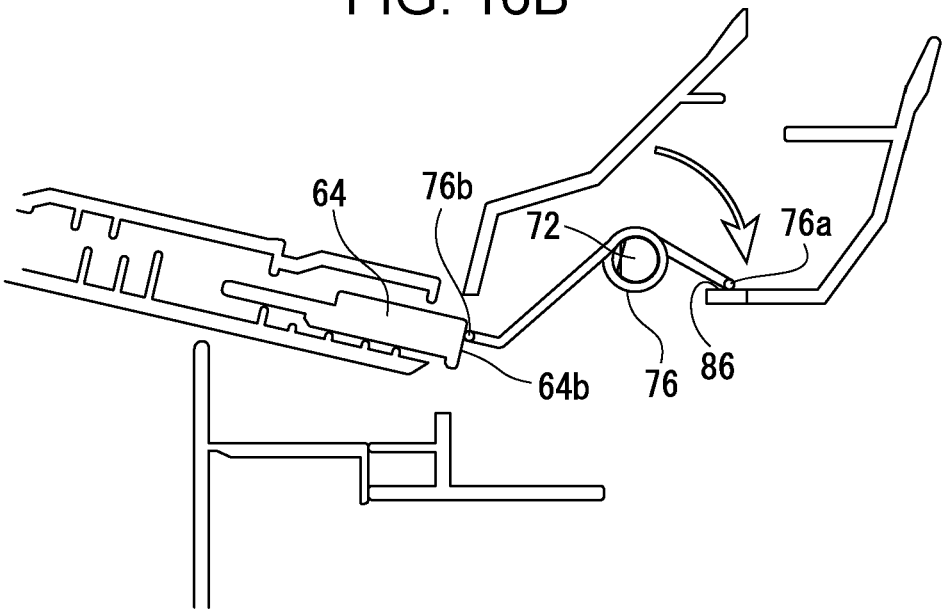

Next, referring to FIGS. 16A and 16B, a sheet feeding device 10 according to a fourth embodiment of the present disclosure will be described. The fourth embodiment differs from the first embodiment in that the fourth embodiment does not include the swing arm 74. In other respects, the fourth embodiment is the same as the first embodiment. Therefore, portions of the fourth embodiment that are common to the first embodiment will be denoted by the same numerals and overlapping descriptions will be omitted or simplified.

In the fourth embodiment, instead of the swing arm 74, the second end portion 76*b* of the spring clutch 76 presses the rotation lever 64. To be specific, as illustrated in FIG. 16A, the spring clutch 76 is attached to the synchronous rotation shaft 72 in a tightened state. In the initial position, the first end portion 76*a* and the second end portion 76*b* of the spring clutch 76 are both free.

With the sheet feeding device 10, the spring clutch 76 swings as the synchronous rotation shaft 72 rotates. Then, when the spring clutch 76 swings to a predetermined angle, as illustrated in FIG. 16A, the second end portion 76*b* of the spring clutch 76 contacts the protruding portion 64*b* of the rotation lever 64, and the rotation lever 64 starts displacement to the second positions by receiving a pressing force from the spring clutch 76. When the rotation lever 64 becomes displaced to the second position and the spring clutch 76 reaches a predetermined swing position, as illustrated in FIG. 16B, the first end portion 76*a* of the spring clutch 76 engages with the engagement portion 86, and deformation of the spring clutch 76 to the loosened state is started. Then, when the spring clutch 76 enters the loosened state, the synchronous rotation shaft 72 idles relative to the spring clutch 76, and the spring clutch 76 stops swinging.

The fourth embodiment has advantages the same as those of the first embodiment. That is, it is not necessary to perform torque control of the spring clutch 76 and to perform load control of the rotation lever 64.

Moreover, with the fourth embodiment, it is possible to further reduce component cost, because the spring clutch 76 also functions as a pressing member.

In each of the embodiments described above, the feed roller 38 is used as a feed member. However, the feed member may be a feed belt.

In each of the embodiments described above, the multifunctional machine 100, which is a combination of a copier, a facsimile, a printer, and the like is used as an example of an image forming apparatus. However, the image forming apparatus may be any one of a copier, a facsimile, a printer, and the like, or may by a multifunctional machine in which at least two of these are combined.

In each of the embodiments described above, the sheet feeding device 10 is used as a manual sheet feeder of the multifunctional machine 100. However, the sheet feeding device 10 can be used as a mechanism for feeding a sheet from the sheet cassette 32. The sheet feeding device 10 can be used as, not only a mechanism for feeding a sheet (recording sheet) on which an image is to be printed, but also as a document feeder for feeding a sheet (document) whose image is to be scanned.

In the above description, modifications of the structures of the second to fourth embodiments from the first embodiment are independently described. However, technical features of the embodiments or the modifications may be used in combination.

The shapes of components described above are only examples, and may be changed in accordance with the specifications of products and the like.

The present disclosure contains subject matter related to that disclosed in Japanese Priority Patent Application JP 2017-005501 filed in the Japan Patent Office on Jan. 17, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A sheet feeding device that feeds a sheet on a tray to a destination by using a feed member, the sheet feeding device comprising:

a rotation shaft that rotates in synchronism with rotation of the feed member;

a spring that is deformable to be in a tightened state in which the spring swings with the rotation shaft when the rotation shaft rotates by tightening the rotation shaft, and to be in a loosened state in which the spring does not swing against the rotation shaft even when the rotation shaft rotates by releasing the tightening of the rotating shaft;

a pressure-receiving member that becomes displaced from a first position to a second position by receiving a pressing force that is generated as the spring swings; and a pressing member that is swingably attached to the rotation shaft;

wherein the spring is in the tightened state when the spring is in an initial position, and the spring starts to be loosened from the tightened state as a first end portion of the spring becomes engaged when the spring swings to a predetermined swing position and the pressure-receiving member is displaced to the second position;

wherein a second end portion of the spring is coupled to the pressing member;

wherein the pressing member presses the pressure-receiving member by swinging as the spring swings; and wherein the pressing member includes a restricting portion that restricts swinging of the pressing member after the first end portion of the spring has been engaged.

2. The sheet feeding device according to claim 1, wherein a second end portion of the spring presses the pressure-receiving member.

3. The sheet feeding device according to claim 1, further comprising:

an urging member for returning the spring to the initial position.

4. The sheet feeding device according to claim 1, wherein an engagement portion that engages with the first end portion of the spring is disposed in such a way that an engagement position thereof is adjustable.

5. An image forming apparatus comprising:

the sheet feeding device according to claim 1; and an image forming unit that forms an image on a sheet fed from the sheet feeding device.

6. A sheet feeding device that feeds a sheet on a tray to a destination by using a feed member, the sheet feeding device comprising:

a rotation shaft that rotates in synchronism with rotation of the feed member;

a spring that is deformable to be in a tightened state in which the spring swings with the rotation shaft when the rotation shaft rotates by tightening the rotation shaft, and to be in a loosened state in which the spring does not swing against the rotation shaft even when the rotation shaft rotates by releasing the tightening of the rotating shaft;

a pressure-receiving member that becomes displaced from a first position to a second position by receiving a pressing force that is generated as the spring swings; and an urging member for returning the spring to the initial position;

wherein the spring is in the tightened state when the spring is in an initial position, and the spring starts to be loosened from the tightened state as a first end portion of the spring becomes engaged when the spring swings to a predetermined swing position and the pressure-receiving member is displaced to the second position.

7. The sheet feeding device according to claim 6, wherein a second end portion of the spring presses the pressure-receiving member.

8. The sheet feeding device according to claim 6, wherein an engagement portion that engages with the first end portion of the spring is disposed in such a way that an engagement position thereof is adjustable.

9. An image forming apparatus comprising:

the sheet feeding device according to claim 6; and an image forming unit that forms an image on a sheet fed from the sheet feeding device.

10. A sheet feeding device that feeds a sheet on a tray to a destination by using a feed member, the sheet feeding device comprising:

a rotation shaft that rotates in synchronism with rotation of the feed member;

a spring that is deformable to be in a tightened state in which the spring swings with the rotation shaft when the rotation shaft rotates by tightening the rotation shaft, and to be in a loosened state in which the spring does not swing against the rotation shaft even when the rotation shaft rotates by releasing the tightening of the rotating shaft; and a pressure-receiving member that becomes displaced from a first position to a second position by receiving a pressing force that is generated as the spring swings, wherein the spring is in the tightened state when the spring is in an initial position, and the spring starts to be loosened from the tightened state as a first end portion of the spring becomes engaged when the spring swings to a predetermined swing position and the pressure-receiving member is displaced to the second position, and wherein in the tightened state, the first end portion of the spring is not engaged.

11. The sheet feeding device according to claim 10, further comprising:

a pressing member that is swingably attached to the rotation shaft, wherein a second end portion of the spring is coupled to the pressing member, and wherein the pressing member presses the pressure-receiving member by swinging as the spring swings.

12. The sheet feeding device according to claim 11, wherein the pressing member includes a restricting portion that restricts swinging of the pressing member after the first end portion of the spring has been engaged.

13. The sheet feeding device according to claim 10, wherein a second end portion of the spring presses the pressure-receiving member.

14. The sheet feeding device according to claim 10, further comprising:

an urging member for returning the spring to the initial position.

15. The sheet feeding device according to claim 10, wherein an engagement portion that engages with the first end portion of the spring is disposed in such a way that an engagement position thereof is adjustable.

16. An image forming apparatus comprising:

the sheet feeding device according to claim 10; and an image forming unit that forms an image on a sheet fed from the sheet feeding device.

* * * * *